US006018709A

United States Patent [19]

Jeffway, Jr.

[11] Patent Number: 6,018,709

[45] **Date of Patent: *Jan. 25, 2000**

[54] SPEECH AND SOUND SYNTHESIZERS WITH CONNECTED MEMORIES AND OUTPUTS

[75] Inventor: Robert W. Jeffway, Jr., Leeds, Mass.

[73] Assignee: Hasbro, Inc., Pawtucket, R.I.

[ * ] Notice: This patent is subject to a terminal disclaimer.

[21] Appl. No.: 09/212,618

[22] Filed: Dec. 15, 1998

Related U.S. Application Data

[63] Continuation of application No. 08/790,541, Jan. 30, 1997, Pat. No. 5,850,628.

[51] Int. Cl.[7] ..... G10L 5/02

[52] U.S. Cl. ..... 704/258

[58] Field of Search ..... 704/258, 264, 704/270, 272, 200; 340/384.5, 384.72

[56] References Cited

U.S. PATENT DOCUMENTS

| | | | |
|---|---|---|---|
| 4,331,836 | 5/1982 | Wiggins, Jr. et al. | 704/264 |
| 4,627,093 | 12/1986 | Hashimoto et al. | 704/258 |
| 4,635,211 | 1/1987 | Yoshida et al. | 704/270 |
| 4,669,121 | 5/1987 | Shigehara et al. | 704/258 |
| 5,850,628 | 12/1998 | Jeffway, Jr. | 704/258 |

*Primary Examiner*—David R. Hudspeth
*Assistant Examiner*—Donald L. Storm
*Attorney, Agent, or Firm*—Fish & Richardson P.C.

[57] ABSTRACT

A speech synthesizing circuit includes a speech synthesizing integrated circuit chip and an audio synthesizing integrated circuit chip. The speech synthesizing integrated circuit chip has a microprocessor, a speech synthesizer, a programmable memory, an input/output port, and a speech address register. The audio synthesizing integrated circuit chip has a microprocessor, an audio synthesizer, a programmable memory, an audio data storage memory, and an input/output port. The input/output port of the speech synthesizing integrated circuit chip is connected to input/output port of the audio data storage memory of the audio synthesizing integrated circuit chip. The programmable memory of the speech synthesizing integrated circuit chip is programmed to cause the microprocessor of the speech synthesizing integrated circuit chip to retrieve speech data from the audio data storage memory of the audio synthesizing integrated circuit chip for speech synthesis by the speech synthesizer of the speech synthesizing integrated circuit chip. The programmable memory is programmed by providing software simulations of instructions preprogrammed into the speech synthesizing integrated circuit chip during manufacture thereof that cause an address to be loaded onto the speech address register, and cause speech data located at an address stored in the speech address register to be obtained. The software simulations cause an address to be loaded into the audio synthesizing integrated circuit chip and cause speech data to be obtained by the speech synthesizing integrated circuit chip from the external memory integrated circuit chip at an address stored in the external memory integrated circuit chip.

34 Claims, 9 Drawing Sheets

Microfiche Appendix Included
(1 Microfiche, 83 Pages)

1) Move Desired Speech Segment Start Address to "A"

2) CALL STPNTR(1)(2)(3) A → Sunplus RAM Location

3) CALL PrepGetP(1)(2)(3)

4) CALL GET (1),(2)···(14)

Inputs and Outputs

| Sunplus Input/Output Lines | TI Input/Output Structure | | | |
|---|---|---|---|---|
| PD0 | Cmd0/Data | PA0 | I/O | Cmd0 and Bi directional Data |
| PD6 | Cmd1/Clock | PA1 | O | Cmd1 and Clock out from the TI processor |
| PD1 | Cmd2/HS | PA2 | O | Cmd2 and Handshaking signal |
| PD4 | Cmd/Strobe | PB1 | O | CmdStrobe from the TI indicating that there is a command on Cmd2-0 |

SunPlus

| | | |
|---|---|---|
| Strobe0 | Output 3 | Keyboard Output Strobe |
| Strobe1 | Output 4 | Keyboard Output Strobe |
| Strobe2 | Output 5 | Keyboard Output Strobe |
| Strobe3 | Output 6 | Keyboard Output Strobe |
| Strobe4 | Output 7 | Keyboard Output Strobe |
| Strobe5 | Output 8 | Keyboard Output Strobe |
| Strobe6 | Output 9 | Keyboard Output Strobe |
| Strobe7 | Output 10 | Keyboard Output Strobe |

FIG. 7

| Command | Operation |
|---|---|
| 0 | Write Keyboard Strobe |
| 1 | Write Pointer 1 |
| 2 | Write Pointer 2 |
| 3 | Write Pointer 3 |
| 4 | Read Data from Pointer 1 |
| 5 | Read Data from Pointer 2 |
| 6 | Read Data from Pointer 3 |
| 7 | Spare |

FIG. 8

SPEECH AND SOUND SYNTHESIZERS WITH CONNECTED MEMORIES AND OUTPUTS

CROSS-REFERENCE TO RELATED APPLICATION

This is a continuation of U.S. patent application Ser. No. 08/790,541, filed on Jan. 30, 1997, now U.S. Pat. No. 5,850,628.

REFERENCE TO APPENDICES

Microfiche Appendices A–D are being submitted with the present application. Microfiche Appendices A–D have 23 frames, 8 frames, 35 frames, and 11 frames respectively, all of which are located on a single microfiche. A claim of copyright is hereby made by Hasbro, Inc. with respect to the software code contained in Microfiche Appendices C and D, as of Dec. 15, 1998. The copyright owner has no objection to the facsimile reproduction by anyone of Microfiche Appendices C and D as they appear in the Patent and Trademark Office patent file or records, but reserves all other copyright rights whatsoever.

BACKGROUND OF THE INVENTION

The present invention relates in general to speech and sound synthesizing circuits and more particularly concerns techniques for combining high-efficiency LPC speech synthesizing chips with the low-cost memory of ADPCM audio synthesizing chips.

One example of LPC (linear predictive coding) speech synthesizing chips is the Texas Instruments TSP50CXX family of LPC chips. These chips are highly efficient in their use of stored speech data because their speech synthesizer models a tube of resonant cavities corresponding to the human vocal cords, mouth, etc. Thus, these chips can synthesize speech at a low data rate. TSP50CXX chips are described in the Texas Instruments Design Manual for the TSP50C0X/1X Family Speech Synthesizer and also in U.S. Pat. Nos. 4,234,761, 4,449,233, 4,335,275, and 4,970,659.

An example of ADPCM (adaptive pulse code modulation) audio synthesizing chips is the Sunplus SPC40A, SPC256A, and SPC512A family of chips. These chips produce speech and other sounds at a high data rate. The chips provide low-cost memory because the chips compete with the LPC chips on a cost-per-second basis, and given that their data usage rate is higher than that of the LPC chips by an order of magnitude, these chips must therefore be designed to achieve a cost per memory element that is lower than that of the LPC chips by an order of magnitude. In addition, these chips do not include complex speech synthesis circuitry.

SUMMARY OF THE INVENTION

One aspect of the invention features a speech synthesizing circuit that includes a speech synthesizing integrated circuit chip and an external memory integrated circuit chip. The speech synthesizing integrated circuit chip includes a microprocessor, a speech synthesizer, a programmable memory, an input/output port, and a speech address register for storing an address containing speech data. The speech synthesizing integrated circuit chip includes an instruction, pre-programmed into the speech synthesizing integrated circuit chip during manufacture thereof, that causes an address to be loaded onto the speech address register. The input/output port of the speech synthesizing integrated circuit chip is connected to the external memory integrated circuit chip. The programmable memory of the speech synthesizing integrated circuit chip is programmed to cause the microprocessor to retrieve speech data from the external memory integrated circuit chip for speech synthesis by the speech synthesizer. The programmable memory is programmed by providing a software simulation of the instruction that causes an address to be loaded onto the speech address register. The software simulation causes the address to be loaded into the external memory integrated circuit chip.

In certain embodiments the external memory is an audio data storage memory of an audio synthesizing integrated circuit chip that could not ordinarily interface directly with the speech synthesizing integrated circuit chip. The software simulation makes it is possible to retrieve speech data from a preferably relatively inexpensive external memory without the use a hardware interface, thereby minimizing overall cost. The minimization of cost is especially important in certain electronic toys.

According to another aspect of the invention, the speech synthesizing integrated circuit chip includes one or more instructions, pre-programmed into the speech synthesizing integrated circuit chip during manufacture thereof, that obtain speech data located at an address stored in the speech address register. At least one of the integrated circuit chips is programmed to cause speech data to be delivered from the external memory integrated circuit chip to the speech synthesizing integrated circuit chip for speech synthesis by the speech synthesizer, by providing a software simulation of the one or more instructions that obtain speech data located at an address stored in the speech address register. The software simulation causes speech data to be obtained by the speech synthesizing integrated circuit chip from the external memory integrated circuit chip at an address stored in the external memory integrated circuit chip.

According to another aspect of the invention, the speech synthesizing integrated circuit chip includes a linear predictive coding (LPC) speech synthesizer and the external memory is the audio data storage memory of an audio synthesizing integrated circuit chip that also includes a microprocessor, an adaptive pulse code modulation (ADPCM) synthesizer, a programmable memory, and an input/output port. The programmable speech data retrieved from the audio data storage memory of the audio synthesizing integrated circuit chip by the speech synthesizing integrated circuit chip is used for speech synthesis by the speech synthesizing integrated circuit chip.

In certain embodiments the programmable memory of the audio synthesizing integrated circuit chip is programmed to cause the microprocessor of the audio synthesizing integrated circuit chip to retrieve audio data (e.g., data for non-speech sounds such as breaking glass, ringing bells, etc.) from the audio data storage memory of the audio synthesizing integrated circuit chip for audio synthesis by the audio synthesizer of the audio synthesizing integrated circuit chip. In other embodiments the audio data from the audio synthesizing integrated circuit chip is delivered to the speech synthesizing integrated circuit chip for speech synthesis by the speech synthesizer.

The ability to combine the LPC speech synthesizing integrated circuit chip and the ADPCM audio synthesizing integrated circuit chip is useful in certain electronic toys, in which the speech synthesizing integrated circuit chip produces speech while the audio synthesizing integrated circuit chip produces non-speech sound effects. The sharing of speech data between the two integrated circuit chips can be an efficient way to take advantage of a preferably relatively inexpensive memory on the audio synthesizing integrated circuit chip and a preferably relatively efficient speech generation algorithm used by the speech synthesizing integrated circuit chip. This makes it possible to provide extended speech at low cost.

According to another aspect of the invention, one of the integrated circuit chips includes a balanced speaker driver having two outputs for connection of a first speaker impedance between the two outputs, and another of the integrated circuit chips includes a single-ended speaker driver having a single output for connection to a second speaker impedance. A speaker is connected between the two outputs of the balanced speaker driver of the first audio synthesizer and is also connected to the single-ended speaker driver of the second audio synthesizer.

The connection of a single speaker to the balanced speaker driver and the single-ended speaker driver (with the use of an appropriate resistance network to ensure that each driver "sees" an appropriate effective resistance to which it is connected) makes it possible to combine audio effects from both integrated circuit chips (for example, speech from one chip and non-speech sound effects from the other chip) with a single speaker, thereby minimizing cost. This minimization of cost is important in certain electronic toys. The audio effects from the two integrated circuit chips can be combined simultaneously if the balanced speaker driver produces a pulse width modulated output while the single-ended speaker driver produces an analog output.

Numerous other features, objects, and advantages of the invention will become apparent from the following detailed description when read in connection with the accompanying drawings.

BRIEF DESCRIPTION OF THE DRAWINGS

FIG. 7 is a listing of functions performed by certain input and output lines of a Texas Instruments TSP50CXX speech synthesizing chip and a Sunplus SPC40A, SPC256A, or SPC512A chip combined together according to the invention.

FIG. 8 is a listing of commands that can be delivered from a Texas Instruments TSP50CXX speech synthesizing chip to a Sunplus SPC40A, SPC256A, or SPC512A chip in accordance with the invention.

DETAILED DESCRIPTION

Figure 1:
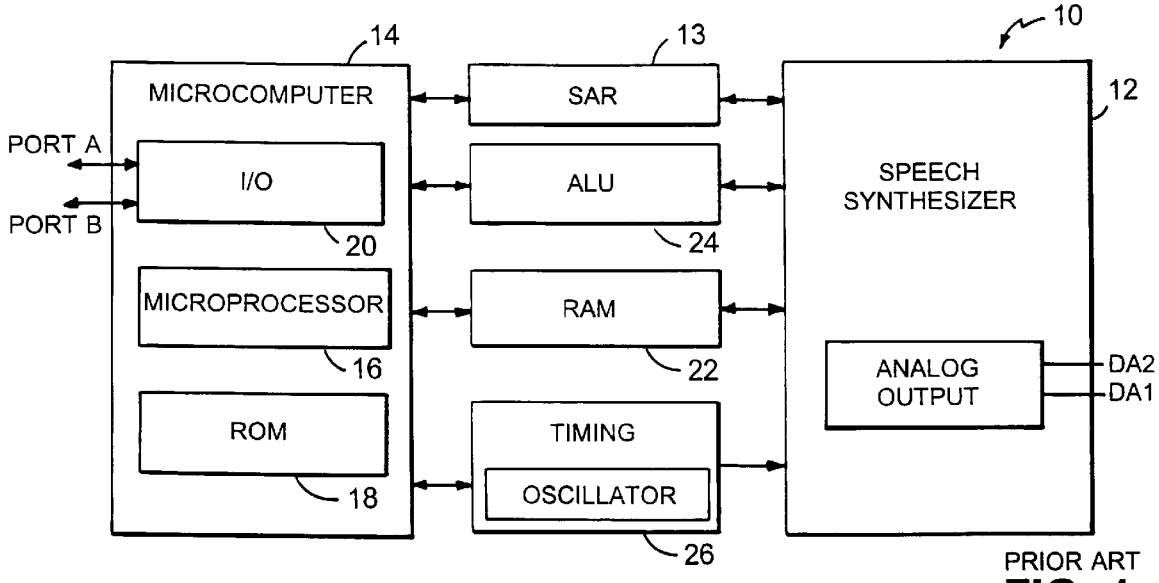
PRIOR ART FIG. 1
FIG. 1 is a functional block diagram of the Texas Instruments TSP50CXX family of speech synthesizing chips.

With reference to FIG. 1, a Texas Instruments TSP50CXX speech synthesizing chip 10, such as a TSP50C1X or TSP50C3X chip, includes an LPC-12 speech synthesizer circuit 12 (Linear Predictive Coding, 12-pole digital filter), which is capable of operating at a speech sample rate ranging up to ten kilohertz or eight kilohertz (but typically at a data rate of only 1.5 kilobits per second for normal speech), and a microcomputer 14 capable of executing up to 600,000 instructions per second. The microcomputer includes an eight-bit microprocessor 16 with sixty-one instructions, a four-kilobyte, six-kilobyte, eight-kilobyte, sixteen-kilobyte, or thirty-two-kilobyte read-only memory 18 for storing program instructions for microprocessor 16 and for storing speech data corresponding to about twelve, twenty, thirty, sixty, or one hundred and twenty seconds of speech, and an input/output circuit 20 for ten software-controllable input/output lines (in the case of a TSP50C1X chip, seven lines for connecting the chip to an external memory or an interface adapter for an external memory, as described below, and three arbitrary lines). Speech synthesizing chip 10 also includes a random-access memory 22 having a capacity of sixteen twelve-bit words and either forty-eight or one hundred and twelve bytes of data, depending on the model of the chip, an arithmetic logic unit 24, an internal timing circuit 26, for use in conjunction with microcomputer 14 and speech synthesizer circuit 12, and a speech address register (SAR) 13 for storing addresses at which speech data is located.

In the case of a TSP50C1X chip, microcomputer 14 includes a built-in interface that enables microcomputer 14 to connect directly to an optional external Texas Instruments TSP60C18 or TSP60C81 read-only memory that is designed to store speech data in addition to the speech data stored in internal read-only memory 18 for use by speech synthesizer circuit 12 (a mode register in speech synthesizer chip 10 contains a flag indicating whether data is to be retrieved from internal read-only memory 18 or an external memory). This built-in interface includes input/output circuit 20 and seven of the input/output lines with which it is associated. The built-in interface is controlled by the program in internal read-only memory 18.

Figure 2:
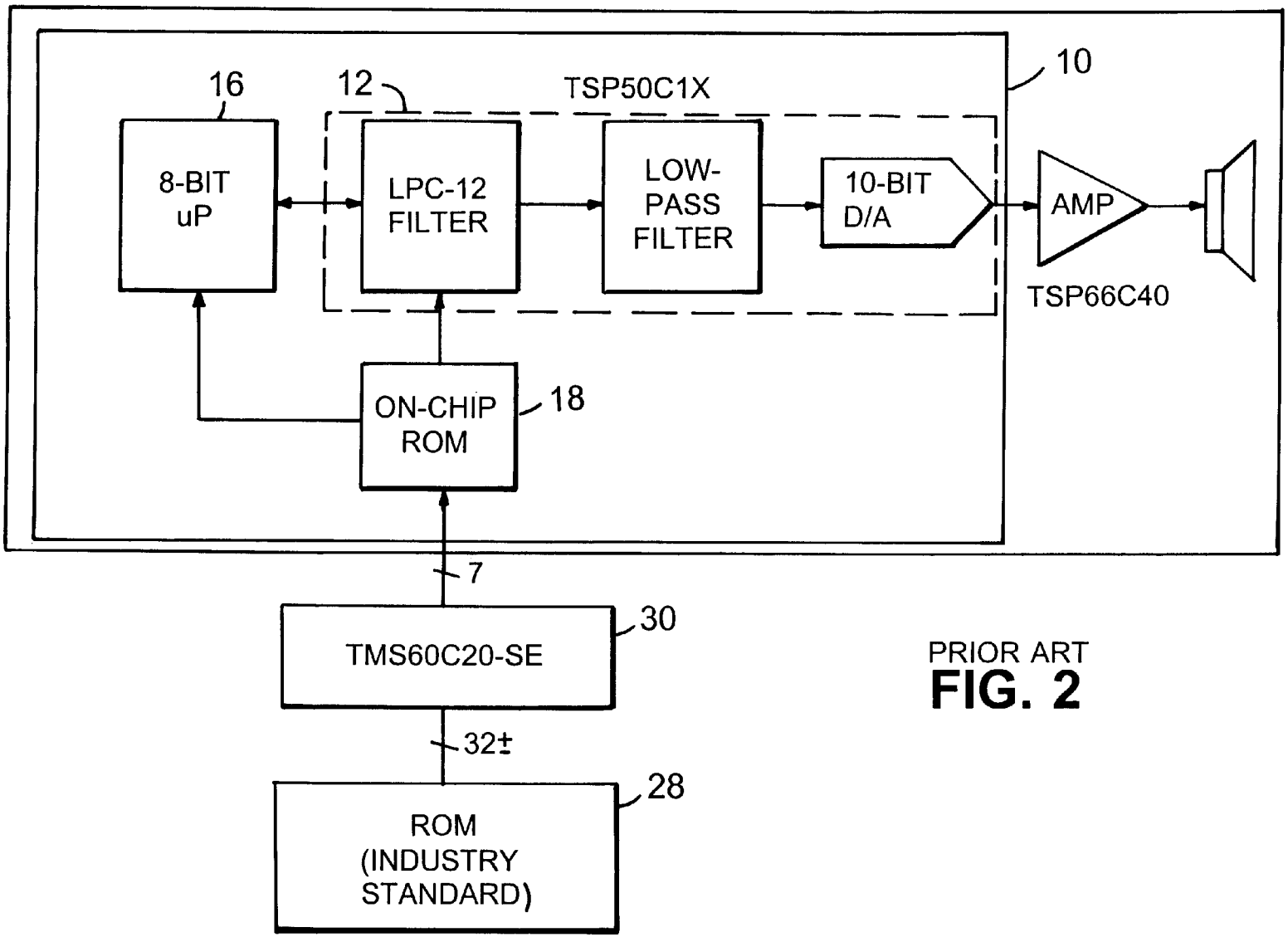
PRIOR ART FIG. 2
FIG. 2 is a block diagram of a Texas Instruments TSP50C1X speech synthesizing chip interfaced with an external memory chip through a Texas Instruments TMS60C20-SE hardware interface chip.

Referring to FIG. 2, as an alternative to connecting a TSP50C1X speech synthesizing chip 10 directly to a TSP60C18 or TSP60C81 read-only memory, speech synthesizing chip 10 can interface with an arbitrary, industry-standard read-only memory 28 through an external Texas Instruments TMS60C20-SE hardware interface chip 30. The connection between speech synthesizing chip 10 and hardware interface chip 30 includes seven of the input/output lines of speech synthesizing chip 10, and the connection between hardware interface chip 30 and read-only memory 28 includes about thirty-two lines. Thus, hardware interface chip 30 makes it possible to connect speech synthesizing chip 10 to an external read-only memory 28 having more output lines than could otherwise be connected to speech synthesizing chip 10. Hardware interface chip 30 is controlled by calls from the program in internal read-only memory 18.

The structure of the Texas Instruments TSP50C3X chips is similar to that of the TSP50C1X chips described above in connection with FIGS. 1 and 2, except that the TSP50C3X chips do not include hardware for connecting to and obtaining data from an external memory. An example of code provided by Texas Instruments for programming read-only memory 18 of a TSP50CXX speech synthesizing chip is attached to this application as Microfiche Appendix A.

Figure 3:
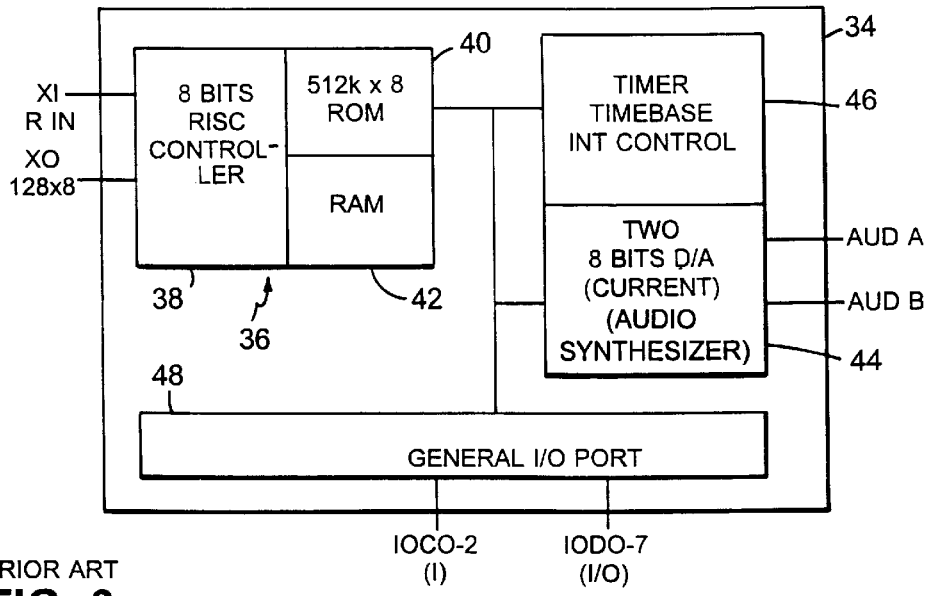
PRIOR ART FIG. 3
FIG. 3 is a functional block diagram of a Sunplus SPC40A, SPC256A, or SPC512A audio synthesizing chip.

With reference to FIG. 3, a Sunplus SPC40A, SPC256A, or SPC512A audio synthesizing chip 34 contains a large microcontroller 36 that includes an eight-bit RISC controller 38, a 40, 256, or 512 kilobyte read-only-memory 40 for storing program instructions for RISC controller 38 and for storing audio data corresponding to about twelve seconds of sound, and a 128-byte random-access memory 42 for use in conjunction with RISC controller 38. Audio synthesizing chip 34 also includes an eight-bit digital-to-analog converter 44 that functions as an audio synthesizer by converting data from read-only-memory 40 to analog signals and an internal timing circuit 46 for coordinating operation of microcontroller 36 and digital-to-analog converter 44. A general input/output port 48 is provided for connecting audio synthesizing chip 34 with external memory for storing additional audio data. Input/output port 48 has sixteen pins in the case of an SPC40A chip, twenty-four pins in the case of an SPC256A chip, and eleven pins in the case of an SPC512A chip.

Audio synthesizing chip 34 typically operates at a data rate of about 24 kilobits per second, which is much higher than the typical data sample rate of the speech synthesizing chip described above in connection with FIG. 1. The speech synthesizing chip of FIG. 1 and the audio synthesizing chip of FIG. 3 are of comparable price and both can store data corresponding to about twelve seconds of sound. The audio synthesizing chip of FIG. 3 must store more data than the speech synthesizing chip of FIG. 1 because of the difference in the data sample rates, and thus it can be said that the audio synthesizing chip of FIG. 3 uses a cheaper memory.

An examples of code provided by Sunplus for programming the read-only memory 40 of an SPC40A, SPC256A, or SPC512A audio synthesizing chip is attached to this application as Microfiche Appendix B.

Figure 4:
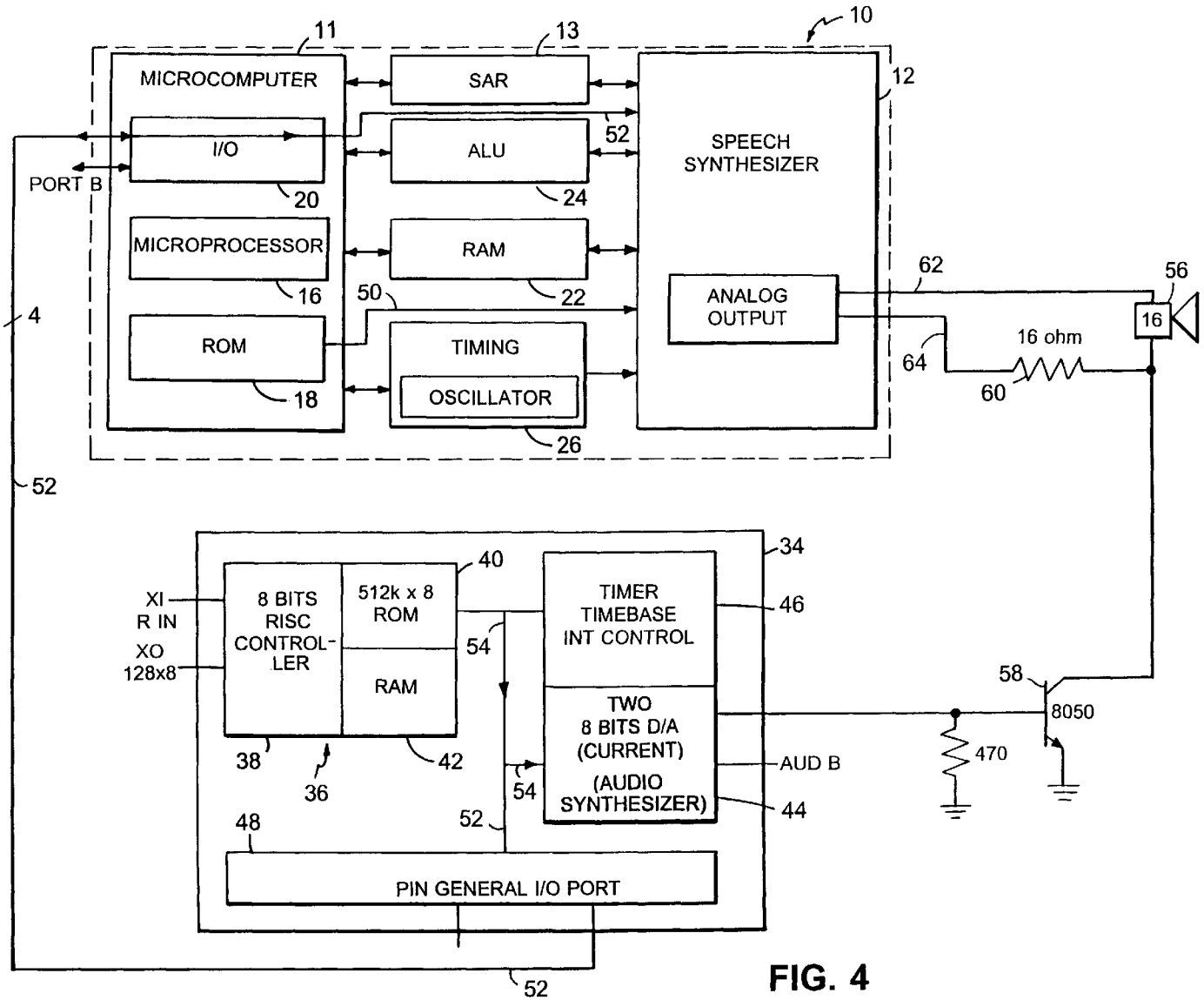
FIG. 4 is a block diagram of a circuit according to the invention combining a Texas Instruments TSP50CXX speech synthesizing chip with a Sunplus SPC40A, SPC256A, or SPC512A audio synthesizing chip.

Referring to FIG. 4, in a circuit according to the present invention the input/output circuit 20 of a Texas Instruments TSP50C1X or TSP50C3X speech synthesizing chip 10 is connected directly to the input/output port 48 of a Sunplus SPC40A, SPC256A, or SPC512A audio synthesizing chip 34 by means of four input/output lines. The flow of audio data is illustrated by paths 50, 52, and 54. In particular, speech synthesizer circuit 12 of speech synthesizing chip 10 receives speech data from read-only memory 18 of speech synthesizing chip 10 along path 50 and also receives additional speech data from read-only memory 40 of audio synthesizing chip 34 along path 52. Digital-to-analog converter 44 of audio synthesizing chip 34 can receive non-speech audio data (e.g., music, breaking glass, ringing bells) from read-only memory 40 of audio synthesizing chip 34 along path 54. Thus, speech synthesizer circuit 12 receives more speech data than can be included in internal read-only memory 18, the additional speech data being received from an external read-only memory 40 that is cheaper per unit of speech data than internal read-only memory 18. Because digital-to-analog converter 44 does not include the LPC speech processing capabilities of speech synthesizer circuit 12, and because speech synthesizer circuit 12 is not specifically designed for synthesizing non-speech sounds, it can be more appropriate to direct non-speech data from read-only memory 40 to digital-to-analog converter 44 than speech synthesizer circuit 12. Both chips 10 and 34 can create sound effects at the same time, with chip 10 producing speech and chip 34 simultaneously producing non-speech sound effects.

The flow of data along paths 50 and 54 is conventional in each of chips 10 and 34, but the flow of data along path 52 is obtained by modifying the standard code for read-only memory 18 and the standard code for read-only memory 40 to permit the direct connection between the two chips. An example of a code modification for read-only memory 18 of chip 10 is attached to this application as Microfiche Appendix C and an example of a code modification for read-only memory 40 is attached as Microfiche Appendix D.

The modification of the code in read-only memory 40 instructs the microprocessor of chip 34 to send speech data to input/output port 48 along path 52 rather than to digital-to-analog converter 44 along path 54. The flow of data along path 52 between chips 10 and 34 occurs through four input/output lines of each of chips 10 and 34. The four input/output lines may be, for example, lines PA0, PA1, PA2, and PB1 of chip 10, and lines PD0, PD6, PD1, and PD4 respectively of chip 34.

Figures 5, 6:
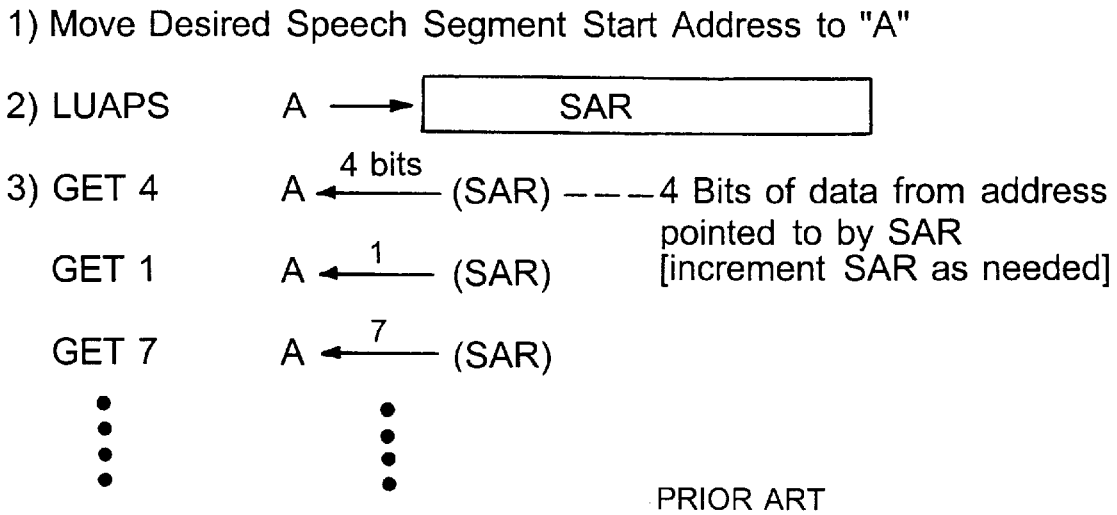
PRIOR ART FIG. 5
FIG. 5 is a listing of steps that utilize the LUAPS and GET instructions of a Texas Instruments TSP50CXX speech synthesizing chip for synthesizing speech.
FIG. 6 is a listing of the steps performed by software simulations, according to the invention, of the steps in FIG. 5.

The modification of the code in read-only memory 18 is a software simulation of the hardware "LUAPS" and "GET" instructions of chip 10 (hardware instructions are implemented by hard-wired gates or micro-code instructions programmed into a chip during manufacture). With reference to FIG. 5, ordinarily, a desired start address of a speech segment is loaded into the A register of chip 10, and then the "LUAPS" instruction loads the address from the A register into the SAR register (Speech Address Register) on chip 10 and loads a parallel-to-serial register on chip 10 with the contents of the address contained in the SAR register. Then, each successive "GET X" instruction transfers X bits from the parallel-to-serial register, to the A register of chip 10. The SAR register is incremented every time the parallel-to-serial register is loaded, and whenever the parallel-to-serial register becomes empty, it is loaded with contents of the address contained in the SAR register. The groups of bits obtained by the "GET" instructions form the frames of LPC parameters described in detail in the above-mentioned Texas Instruments Design Manual and patents. In the TSP50C1X chips, the address pointed to by the SAR register may be on-chip or off-chip (if a specially configured Texas Instruments external memory is used), because the TSP50C1X chips include hardware for connecting to and obtaining data from a specially configured Texas Instruments external memory. In the TSP50C3X chips the address pointed to by the SAR register must be on-chip.

With reference to FIG. 6, according to the present invention, a software simulation of the LUAPS and GET instructions of FIG. 5 is provided. Instead of loading the address from the A register of the LPC chip into an SAR register as in the case of the LUAPS instruction of FIG. 5, CALL STPNTR(X) causes pointer X to be stored in the ADPCM chip. Instead of loading a parallel-to-serial register in the LPC chip with the contents of the address contained in an SAR register and transferring bits from the parallel-to-serial register to the A register of the LPC chip as in the case of the LUAPS and GET instructions of FIG. 5, CALL PREPGET P(X) prepares the ADPCM chip to send to the LPC chip the data to which pointer X points, and CALL GET(Y) causes Y bits of data pointed to by pointer X to be read from the ADPCM chip. In one embodiment, up to three pointers are used, so that data can be read from up to three sets of storage locations corresponding to three different sounds to be produced simultaneously by the LPC chip (for example, music with three-part harmony).

With reference to FIG. 7, according to the input/output structure of the LPC chip provided by the invention, the interface operation is accomplished over four wires and is a command-driven structure. All commands are initialized on the side of the LPC chip and the ADPCM chip is slave to the requested operations. Lines PA0–2 provide command codes to the ADPCM chip, and line PB1 indicates to the ADPCM chip that there is a command on lines PA0–2. The LPC chip drops command strobe line PB1 after setting up a command on lines PA0–2, and the ADPCM chip responds by executing the command that was strobed. Thus, the processor of the LPC chip initiates each command and the processor of the ADPCM chip executes that command.

The various commands are shown in FIG. 8. Commands 1–3 indicate that data pointer 1, 2, or 3 is to be sent to the ADPCM chip (this corresponds to CALL STPNTR(X)), and commands 4–6 indicate that data to which pointer 1, 2, or 3 points is to be read from the ADPCM chip (this corresponds to CALL PREPGET P(X). In one particular embodiment useful in certain toys, command 0 instructs the ADPCM chip to strobe one of eight strobe outputs to a game keyboard.

Referring again to FIG. 7, once the ADPCM chip has received the appropriate command, line PA0 is used to read data from the ADPCM chip or send a pointer to the ADPCM chip, and line PA1 is used to clock the data serially into or out of the LPC chip. The ADPCM processor maintains address pointers and counter that are advanced on clock events received on line PA1. Line PA2 is used as a handshake signal during the process of reading data from the ADPCM chip.

Figure 9:
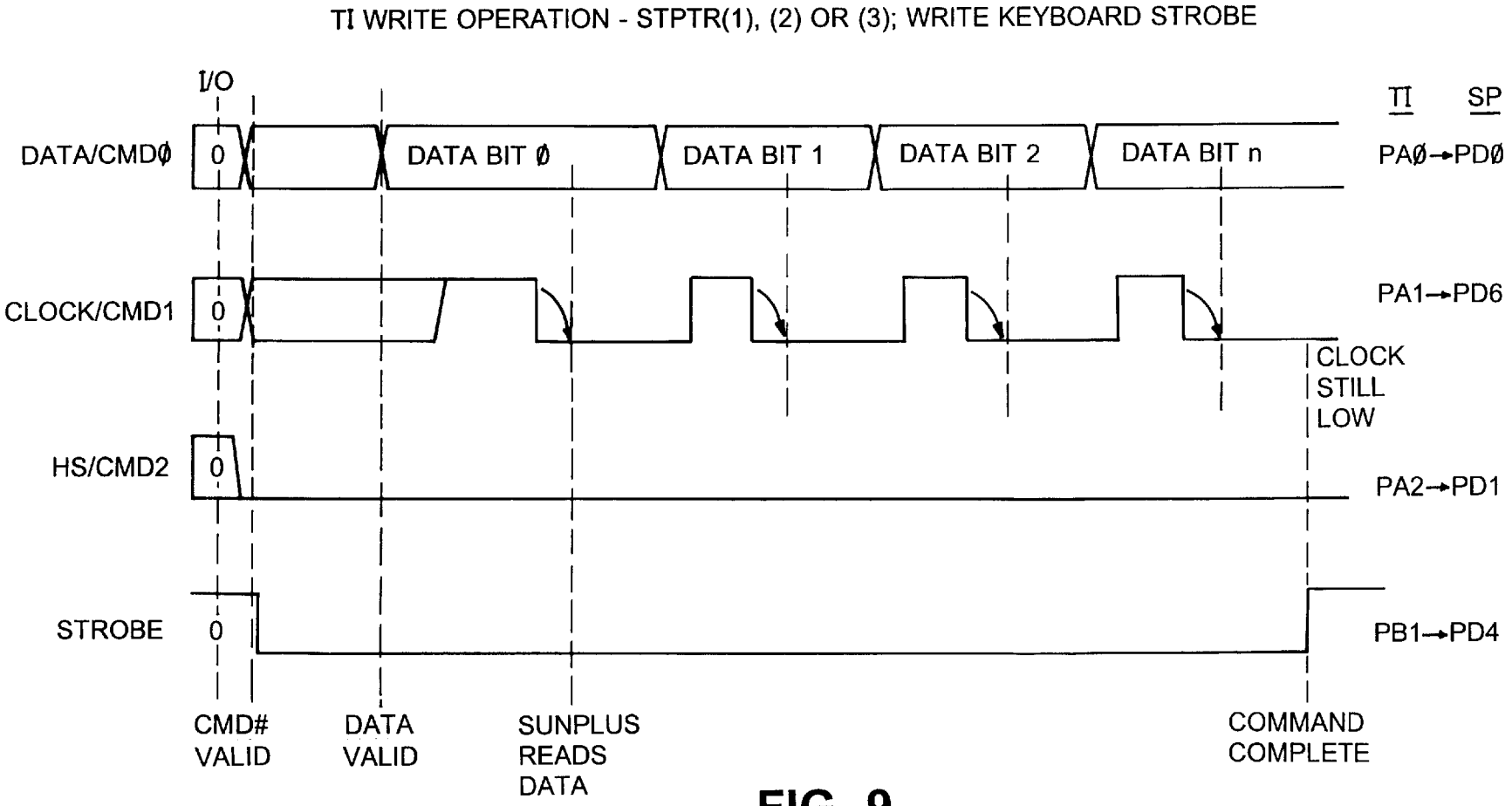
FIG. 9 is a timing diagram of a write operation in accordance with the invention.

With reference to FIG. 9, the LPC processor will perform CALL STPNTR(X) by placing a "Write Pointer X" command on lines PA0–PA2 and lowering strobe line PB1. After a period of time sufficient for the ADPCM chip to read the command has elapsed, the LPC chip provides the first bit of data on line PA0 and then drops the clock signal on line PA1. During the clock low time the ADPCM chip will accept and read in the bit on line PA0, and then the next bit of data is placed on line PA1, and so on. Operations that write data from the LPC processor to the ADPCM processor are done without a handshaking signal. The data is clocked out by a fixed clock cycle. The clock cycle time is the minimum time required for the ADPCM chip to reliably clock in the data. The LPC processor completes the operation by raising strobe line PB1 high.

When the ADPCM chip detects a "Write Pointer X" command it will expect up to sixteen clocked data bits. When the operation is complete the ADPCM chip stores the received value as Pointer X. It is possible to clock in fewer than sixteen bits of data to specify an address. In particular, the first bit read out is the first bit of the address, and once strobe line PB1 goes high, the unclocked data bits are all assumed to be zeros.

The timing diagram of FIG. 9 is also used in connection with the "Write Keyboard Strobe" command (Command 0 in FIG. 8). When the ADPCM chip detects a "Write Keyboard Strobe" command it will expect a clocked data bit to specify the next output state. Once strobe line PB1 goes high, the ADPCM chip drives the strobe lines to the proper value. In this way, the LPC chip controls eight outputs of the ADPCM chip, and thus the interface between the LPC and ADPCM chips effectively increases the number of input/output lines available to the LPC chip.

Figure 10:
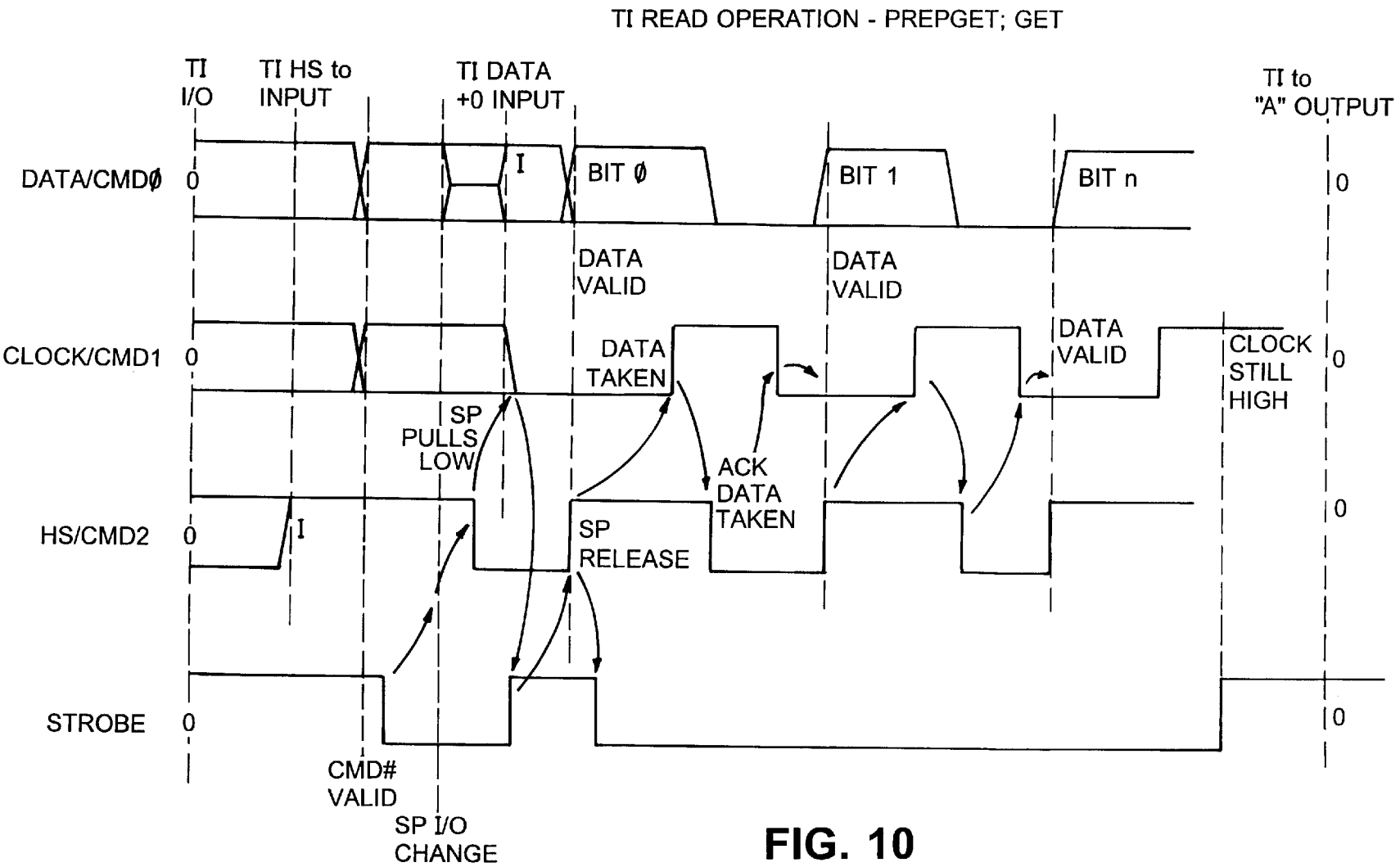
FIG. 10 is a timing diagram of a read operation in accordance with the invention.

With reference to FIG. 10, operations that read data from the ADPCM chip to the LPC chip involve a handshaking signal on line PA2. The "Read Data from Pointer X" commands (see discussion of FIG. 8 above) require line PA2 to be high, which is necessary in order for handshaking to proceed correctly. This is because line PA2 is configured as an open-drain output at initialization, externally pulled high by a 10 K resistor.

When the LPC processor performs CALL PREPGET P(X) in order to prepare to read data, the LPC chip issues a "Read Data from Pointer X" command on lines PA0–1 and then lowers strobe PB1. In response to the command, the ADPCM chip switches from its default input mode to an output mode with respect to lines PA0 and PA2 of the LPC chip (consequently, for a brief period of time, line PA0 of the LPC chip will receive output signals from both the LPC chip and the ADPCM chip). The ADPCM chip then acknowledges acceptance of the command by pulling low line PA2 of the LPC chip. The LPC chip then performs CALL GET(Y) by setting line PA0 to an input, lowering line PA1 to start the clocking of data, and raising strobe line PB1 to indicate to the ADPCM chip that the LPC chip is ready to receive data. The ADPCM chip places the first bit of data on line PA0 and releases line PA2. The LPC chip reads the data and raises the clock signal on PA1 to signal that the data has been read. The ADPCM chip responds by advancing an internal bit counter and pulling line PA2 low to acknowledge receipt of the clock signal, and the LPC chip then responds by lowering line PA1 to start the clocking of the next bit of data. The ADPCM chip then places the next bit of data on line PA0 and releases line PA2, and the process continues until the LPC chip has received as much data as it wants. The LPC processor completes the operation by raising strobe line PB1 high after Y bits of data have been received.

The four-wire interface between the two chips may also be used to transfer non-speech data in either direction between the LPC RAM and the ADPCM RAM, in a manner similar to the timing diagrams of FIGS. 9 and 10, in order to effectively expand the amount of RAM available to the master chip (the LPC chip in the embodiments described above).

Figure 11:
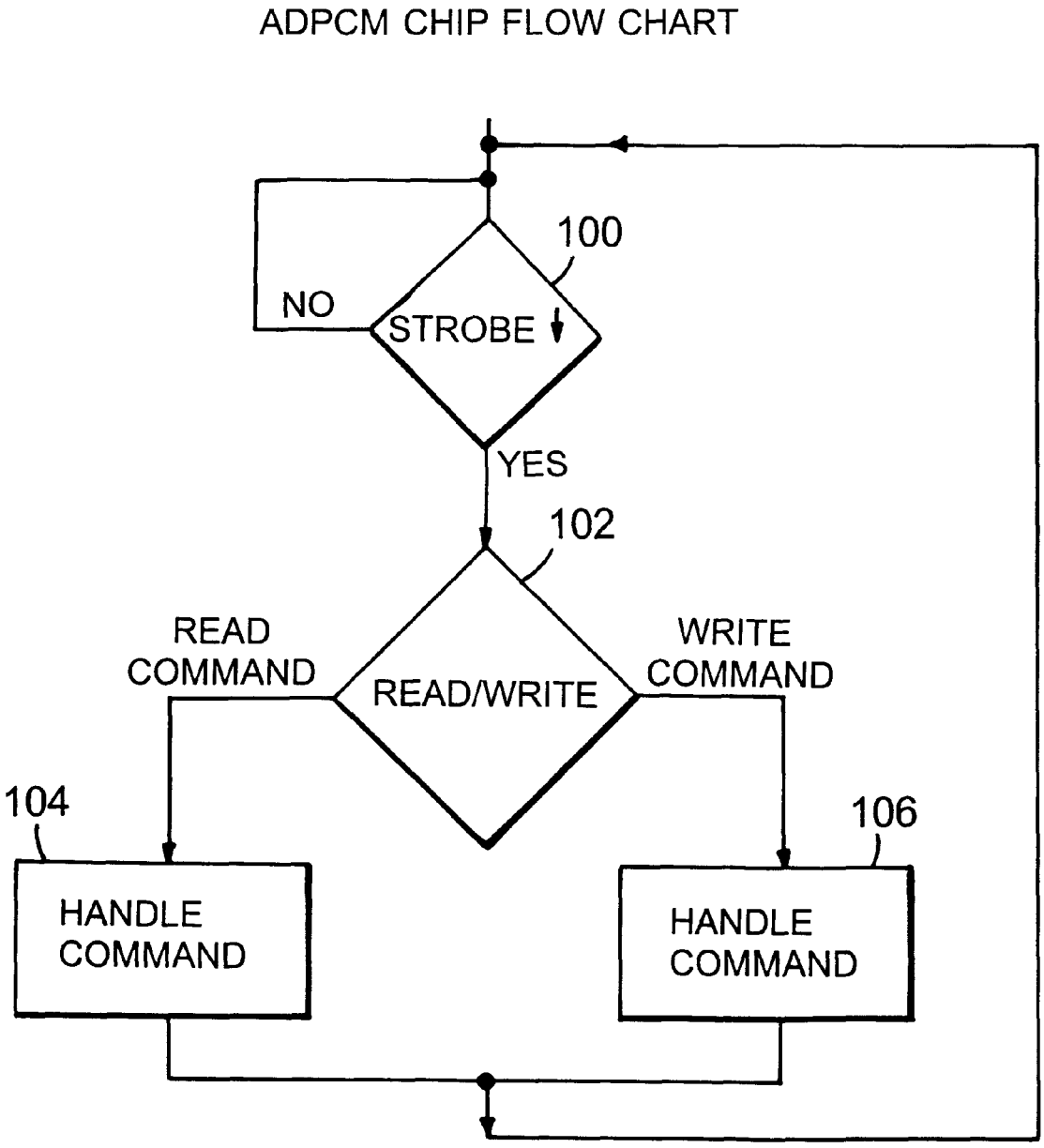
FIG. 11 is a flow chart of the operation of a Sunplus SPC40A, SPC256A, or SPC512A chip according to the invention.

FIG. 11 is a flow chart of the operation of the ADPCM chip. The ADPCM chip watches for strobe line PB1 of the LPC chip to go down (step 100), and when this happens the ADPCM chip receives a read or write command on lines PA0–PA2 of the ADPCM chip (step 102), handles the read command (step 104; FIG. 10) or write command (step 106; FIG. 12), and then returns to step 100.

In another alternative embodiment, the ADPCM chip can be set up as the master microcontroller, and the LPC chip can function as the slave. In this embodiment there is no need to perform a software simulation of the LUAPS instruction of the LPC chip, because the pointers to the data in the ADPCM chip all originate from the ADPCM chip itself. It will now be apparent to those skilled in the art that data can be transferred from the ADPCM chip to the LPC chip according to a technique similar to the technique shown in the timing diagram of FIG. 10 (the initial synchronization process at the beginning of the timing diagram would differ but then the actual data transfer process could proceed in a manner similar to that shown in FIG. 10). Thus, a type of software simulation of the LUAPS and GET instructions of the LPC chip can be performed, even though the LPC chip in this particular embodiment functions as a slave.

With reference to FIG. 4, the outputs of speech synthesizer circuit 12 of chip 10 and digital-to-analog converter 44 of chip 34 are connected to a single speaker 56. The output of speech synthesizer circuit 12 is a pulse-width-modulated push-pull bridge balanced drive for a 32-ohm speaker, and the output of digital-to-analog converter 44, amplified by transistor 58, is a single-ended drive for an 8-ohm speaker. The output of digital-to-analog converter 44, amplified by transistor 58, is connected to a node between 16-ohm speaker 56 and 16-ohm resistor 60. Thus, the output of digital-to-analog converter 44 is connected to two parallelly connected 16-ohm resistances, or, in other words, an 8-ohm single-ended resistance. At the same time, the output of speech synthesizer circuit 12 is connected to two series-connected 16-ohm resistances, or, in other words, a 32-ohm resistance.

When speech synthesizer 12 is silent, its push-pull bridge balanced drive goes to low impedance, and the two outputs 62 and 64 of the push-pull bridge balanced drive are at a positive voltage. This makes it possible for current to pass from output 62, through speaker 56, and through amplifier 58 while audio synthesizer integrated circuit chip 34 is operating.

When chip 34 is silent, transistor 58 goes to high impedance (i.e., transistor 58 switches off). Meanwhile, pulse width modulated current may pass between outputs 62 and 64 of the push-pull bridge balanced drive of speech synthesizer 12 through speaker 56 while speech synthesizer 12 is operating.

It is possible for both of chips 10 and 34 to operate simultaneously with the single speaker 56 because, when chip 10 is operating, output 62 of speech synthesizer 12 pulses high and low, and whenever output 62 is high, current can pass from output 62 through transistor 58 to produce the audio sounds synthesized by chip 34. The frequency of on and off pulsing of output 62 is too fast to affect the perceived sound output produced by chip 34.

There has been described novel and improved apparatus and techniques for speech and sound synthesizing. It is evident that those skilled in the art may now make numerous uses and modifications of and departures from the specific embodiment described herein without departing from the inventive concept.

What is claimed is:

1. A speech synthesizing circuit, comprising:

a speech synthesizing integrated circuit chip having a microprocessor, a speech synthesizer, a programmable memory, an input/output port, and a speech address register for storing an address containing speech data, the speech synthesizing integrated circuit chip including an instruction, pre-programmed into the speech synthesizing integrated circuit chip during manufacture thereof, that, when executed, can cause an address to be loaded into the speech address register; and an external memory integrated circuit chip, the input/output port of the speech synthesizing integrated circuit chip being connected to the external memory integrated circuit chip;

the programmable memory of the speech synthesizing integrated circuit chip being programmed to cause the microprocessor to retrieve speech data from the external memory integrated circuit chip for speech synthesis by the speech synthesizer, the programmable memory being programmed by providing a software simulation of the instruction that can cause an address to be loaded into the speech address register, the software simulation causing the address to be loaded into the external memory integrated circuit chip without reliance on execution of the instruction pre-programmed into the speech synthesizing integrated circuit chip to load the address;

wherein the external memory integrated circuit chip comprises an audio synthesizing integrated circuit chip selected from the family of SP chips.

2. The speech synthesizing circuit of claim 1 wherein the speech synthesizing integrated circuit chip comprises hardware for connecting to and obtaining data from an external memory.

3. The speech synthesizing circuit of claim 1 wherein the external memory integrated circuit chip comprises an audio synthesizing integrated circuit chip having a microprocessor, an audio synthesizer, an input/output port, and an audio data storage memory.

4. The speech synthesizing circuit of claim 3 wherein the audio synthesizing integrated circuit chip comprises a programmable memory programmed to cause the microprocessor of the audio synthesizing integrated circuit chip to retrieve audio data from the audio data storage memory of the audio synthesizing integrated circuit chip for audio synthesis by the audio synthesizer of the audio synthesizing integrated circuit chip.

5. The speech synthesizing circuit of claim 4 wherein the programmable memory of the audio synthesizing integrated circuit chip comprises the audio data storage memory of the audio synthesizing integrated circuit chip.

6. The speech synthesizing circuit of claim 3 wherein the speech synthesizer of the speech synthesizing integrated circuit chip processes speech data at a higher efficiency than the audio synthesizer of the audio synthesizing integrated circuit chip processes.

7. The speech synthesizing circuit of claim 6 wherein the speech synthesizer of the speech synthesizing integrated circuit chip comprises a linear predictive coding synthesizer.

8. The speech synthesizing circuit of claim 7 wherein the speech synthesizing integrated circuit chip is selected from the family of TSP50C4X, TSP50C1X, and TSP50C3X chips.

9. The speech synthesizing circuit of claim 8 wherein the speech synthesizing integrated circuit chip comprises a TSP50C3X chip.

10. The speech synthesizing circuit of claim 6 wherein the audio synthesizer of the audio synthesizing integrated circuit chip comprises an adaptive pulse code modulation synthesizer.

11. The speech synthesizing circuit of claim 10 wherein the audio synthesizing integrated circuit chip is selected from the family of SPC chips.

12. The speech synthesizing circuit of claim 3 wherein:

the speech synthesizing integrated circuit chip comprises a balanced speaker driver having two outputs for connection of a first speaker impedance between the two outputs;

the audio synthesizing integrated circuit chip comprises a single-ended speaker driver having a single output for connection to a second speaker impedance; and a speaker is connected between the two outputs of the balanced speaker driver of the speech synthesizing integrated circuit chip and is also connected to the single-ended speaker driver of the audio synthesizing integrated circuit chip.

13. The speech synthesizing circuit of claim 1 wherein the programmable memory of the speech synthesizing integrated circuit chip is programmed with speech data for speech synthesis by the speech synthesizer.

14. A method of combining a speech synthesizing integrated circuit chip with an external memory integrated circuit chip, comprising the steps of:

providing a speech synthesizing integrated circuit chip having a microprocessor, a speech synthesizer, a programmable memory, an input/output port, and a speech address register for storing an address containing speech data, the speech synthesizing integrated circuit chip including an instruction, pre-programmed into the speech synthesizing integrated circuit chip during manufacture thereof, that, when executed, can cause an address to be loaded into the speech address register;

providing the external memory integrated circuit chip;

connecting the input/output port of the speech synthesizing integrated circuit chip with the external memory integrated circuit chip;

programming the programmable memory of the speech synthesizing integrated circuit chip to cause the microprocessor to retrieve speech data from the external memory integrated circuit chip for speech synthesis by the speech synthesizer, the programmable memory being programmed by providing a software simulation of the instruction that can cause an address to be loaded into the speech address register, the software simulation causing the address to be loaded into the external memory integrated circuit chip without reliance on execution of the instruction pre-programmed into the speech synthesizing integrated circuit chip to load the address;

wherein the external memory integrated circuit chip comprises an audio synthesizing integrated circuit chip selected from the family of SP chips.

15. A speech synthesizing circuit, comprising:

a speech synthesizing integrated circuit chip having a microprocessor, a speech synthesizer, and a programmable memory, an input/output port, the speech synthesizing integrated circuit chip including one or more instructions, pre-programmed into the speech synthesizing integrated circuit chip during manufacture thereof, that, when executed, can obtain speech data located at an address stored in a speech address register that stores an address at which speech data is located; and an external memory integrated circuit chip, the input/output port of the speech synthesizing integrated circuit chip being connected to the external memory integrated circuit chip;

at least one of the integrated circuit chips being programmed to cause speech data to be delivered from the external memory integrated circuit chip to the speech synthesizing integrated circuit chip for speech synthesis by the speech synthesizer, by providing a software simulation of execution of the one or more instructions that can obtain speech data located at an address stored in the speech address register, the software simulation causing speech data to be obtained by the speech synthesizing integrated circuit chip from the external memory integrated circuit chip at an address stored in the external memory integrated circuit chip without reliance on execution of the one or more instructions pre-programmed into the speech synthesizing integrated circuit chip to obtain speech data;

wherein the external memory integrated circuit chip comprises an audio synthesizing integrated circuit chip selected from the family of SP chips.

16. The speech synthesizing circuit of claim 15, wherein the programmable memory of the speech synthesizing integrated circuit chip is programmed to cause speech data to be delivered from the external memory integrated circuit chip to the speech synthesizing integrated circuit chip for speech synthesis by the speech synthesizer, by providing the software simulation of the one or more instructions that obtain speech data located at an address stored in the speech address register.

17. The speech synthesizing circuit of claim 15 wherein the speech synthesizing integrated circuit chip comprises hardware for connecting to and obtaining data from an external memory.

18. The speech synthesizing circuit of claim 15 wherein the external memory integrated circuit chip comprises an audio synthesizing integrated circuit chip having a microprocessor, an audio synthesizer, an input/output port, and an audio data storage memory.

19. The speech synthesizing circuit of claim 18 wherein the audio synthesizing integrated circuit chip comprises a programmable memory programmed to cause the microprocessor of the audio synthesizing integrated circuit chip to retrieve audio data from the audio data storage memory of the audio synthesizing integrated circuit chip for audio synthesis by the audio synthesizer of the audio synthesizing integrated circuit chip.

20. The speech synthesizing circuit of claim 19 wherein the programmable memory of the audio synthesizing integrated circuit chip comprises the audio data storage memory of the audio synthesizing integrated circuit chip.

21. The speech synthesizing circuit of claim 18 wherein the speech synthesizer of the speech synthesizing integrated circuit chip processes speech data at a higher efficiency than the audio synthesizer of the audio synthesizing integrated circuit chip processes.

22. The speech synthesizing circuit of claim 21 wherein the speech synthesizer of the speech synthesizing integrated circuit chip comprises a linear predictive coding synthesizer.

23. The speech synthesizing circuit of claim 22 wherein the speech synthesizing integrated circuit chip is selected from the family of TSP50C4X, TSP50C1X, and TSP50C3X chips.

24. The speech synthesizing circuit of claim 23 wherein the speech synthesizing integrated circuit chip comprises a TSP50C3X chip.

25. The speech synthesizing circuit of claim 21 wherein the audio synthesizer of the audio synthesizing integrated circuit chip comprises an adaptive pulse code modulation synthesizer.

26. The speech synthesizing circuit of claim 21 wherein the audio synthesizing integrated circuit chip is selected from the family of SPC chips.

27. The speech synthesizing circuit of claim 18 wherein:

the speech synthesizing integrated circuit chip comprises a balanced speaker driver having two outputs for connection of a first speaker impedance between the two outputs;

the audio synthesizing integrated circuit chip comprises a single-ended speaker driver having a single output for connection to a second speaker impedance; and a speaker is connected between the two outputs of the balanced speaker driver of the speech synthesizing integrated circuit chip and is also connected to the single-ended speaker driver of the audio synthesizing integrated circuit chip.

28. The speech synthesizing circuit of claim 15 wherein the programmable memory of the speech synthesizing integrated circuit chip is programmed with speech data for speech synthesis by the speech synthesizer.

29. A method of combining a speech synthesizing integrated circuit chip with an external memory integrated circuit chip, comprising the steps of:

providing a speech synthesizing integrated circuit chip having a microprocessor, a speech synthesizer, and a programmable memory, an input/output port, the speech synthesizing integrated circuit chip including one or more instructions, pre-programmed into the speech synthesizing integrated circuit chip during manufacture thereof, that, when executed, can obtain speech data located at an address stored in a speech address register that stores an address at which speech data is located;

providing the external memory integrated circuit chip;

connecting the input/output port of the speech synthesizing integrated circuit chip with the external memory integrated circuit chip;

programming at least one of the integrated circuit chips to cause speech data to be delivered from the external memory integrated circuit chip to the speech synthesizing integrated circuit chip for speech synthesis by the speech synthesizer, by providing a software simulation of execution of the one or more instructions that can obtain speech data located at an address stored in the speech address register, the software simulation causing speech data to be obtained by the speech synthesizing integrated circuit chip from the external memory integrated circuit chip at an address stored in the external memory integrated circuit chip without reliance on execution of the one or more instructions pre-programmed into the speech synthesizing integrated circuit chip to obtain speech data;

wherein the external memory integrated circuit chip comprises an audio synthesizing integrated circuit chip selected from the family of SP chips.

30. A speech synthesizing circuit, comprising:

a speech synthesizing integrated circuit chip having a microprocessor, a speech synthesizer, and an input/output port for interfacing with an external memory; and a sound synthesizing integrated circuit chip having a microprocessor, a sound synthesizer having a data rate substantially greater than that of the speech synthesizer of the speech synthesizing integrated circuit chip, an input/output port, and a sound data storage memory;

the input/output port of the speech synthesizing integrated circuit chip being interfaced with the input/output port of the sound synthesizing integrated circuit chip;

at least one of the integrated circuit chips being programmed to cause the microprocessor of the speech synthesizing integrated circuit chip to retrieve speech data from the sound data storage memory of the sound synthesizing integrated circuit chip for speech synthesis by the speech synthesizer of the speech synthesizing integrated circuit chip;

wherein the sound synthesizing integrated circuit chip is selected from the family of SP chips.

31. The speech synthesizing circuit of claim 30 wherein the sound synthesizing integrated circuit chip is programmed to cause the microprocessor of the sound synthesizing integrated circuit chip to retrieve sound data from the sound data storage memory of the sound synthesizing integrated circuit chip for sound synthesis by an adaptive pulse code modulation synthesizer of the sound synthesizing integrated circuit chip.

32. The speech synthesizing circuit of claim 30 wherein the speech synthesizing integrated circuit chip is selected from the family of TSP50C4X, TSP50C1X, and TSP50C3X chips.

33. The speech synthesizing circuit of claim 32 wherein the speech synthesizing integrated circuit chip comprises a TSP50C3X chip.

34. A method of combining a speech synthesizing integrated circuit chip and a sound synthesizing integrated circuit chip, comprising the steps of:

providing a speech synthesizing integrated circuit chip having a microprocessor, a speech synthesizer, and an input/output port for interfacing with an external memory;

providing a sound synthesizing integrated circuit chip having a microprocessor, a sound synthesizer having a data rate substantially greater than that of the speech synthesizer of the speech synthesizing integrated circuit chip, an input/output port, and a sound data storage memory;

interfacing the input/output port of the speech synthesizing integrated circuit chip with the input/output port of the sound synthesizing integrated circuit chip; and programming at least one of the integrated circuit chips to cause the microprocessor of the speech synthesizing integrated circuit chip to retrieve speech data from the sound data storage memory of the sound synthesizing integrated circuit chip for speech synthesis by the speech synthesizer of the speech synthesizing integrated circuit chip;

wherein the sound synthesizing integrated circuit chip is selected from the family of SP chips.

* * * * *